US008102080B2

(12) United States Patent
Fonseca et al.

(10) Patent No.: US 8,102,080 B2
(45) Date of Patent: Jan. 24, 2012

(54) CONTROL SYSTEM FOR AN APPLIANCE

(75) Inventors: Julia Fonseca, Houston, TX (US); Robert Marten Bultman, Louisville, KY (US); Bobby Hayes, Smithfield, KY (US)

(73) Assignee: General Electric Company, Schenectady, NY (US)

( * ) Notice: Subject to any disclaimer, the term of this patent is extended or adjusted under 35 U.S.C. 154(b) by 397 days.

(21) Appl. No.: 12/536,557

(22) Filed: Aug. 6, 2009

(65) Prior Publication Data

US 2009/0294434 A1 Dec. 3, 2009

Related U.S. Application Data

(63) Continuation-in-part of application No. 11/966,047, filed on Dec. 28, 2007, now abandoned.

(51) Int. Cl.
*H01H 47/00* (2006.01)

(52) U.S. Cl. ..... 307/130

(58) Field of Classification Search ..... 55/32; 307/31, 307/38, 130

See application file for complete search history.

(56) References Cited

U.S. PATENT DOCUMENTS 6,969,927 B1 11/2005 Lee
7,098,555 B2 * 8/2006 Glahn et al. ..... 307/32
7,170,194 B2 1/2007 Korcharz et al.

* cited by examiner

*Primary Examiner* — Michael Rutland Wallis
(74) *Attorney, Agent, or Firm* — Global Patent Corporation; Douglas D. Zhang

(57) ABSTRACT

A control system for determining a magnitude of a voltage and controlling an application of the voltage to at least one load device of an appliance is disclosed. The control system includes a threshold-crossing circuit configured to receive a representation of the voltage and to provide an output signifying the voltage crossing a predetermined voltage threshold; and a processor which receives the output from the threshold-crossing circuit and determine the magnitude of the voltage based on the output and a line frequency based on the period of the output, determines an initial cooking profile from a group of cooking profiles based on a user selected initial setting for controlling the application of the voltage to the at least one load device, and adjusts the application of the voltage to the at least one load device based on the determined magnitude of the voltage.

14 Claims, 6 Drawing Sheets

EXAMPLE DELAY DUTY CYCLE = 50%

D.C = 50%, DECREASED HEATING TIME, PERFORMANCE ALTERED

D.C = 75%, PERFORMANCE MAINTAINED

CONTROL SYSTEM FOR AN APPLIANCE

CROSS REFERENCE TO RELATED APPLICATIONS

This application is a continuation-in-part application of application Ser. No. 11/966,047, filed on Dec. 28, 2007 now abandoned, the contents of which are incorporated herein by reference.

BACKGROUND OF THE INVENTION

The present invention relates generally to a control system and a control method for an appliance. More specifically, the present invention relates to a control system and a method for determining a working profile for a cooking/heating appliance such as a cooking range. The control system is configured to measure the line voltage for the cooking/heating appliance and to adjust a working profile and/or load outputs of the cooking/heating appliance accordingly.

In different geographic areas within the U.S. as well as among various countries throughout the world, the nominal line voltage can differ significantly. The typical nominal line voltage is 208V, 220V, or 240V. However, the actual voltage can vary from the nominal line voltage. In resistive loads such as electrical cooking/heating elements used in cooking/heating appliances, relatively large load output changes can occur with relatively small changes in the line voltage since load output varies with the square of the voltage. Similar load output changes can occur with non-resistive loads such as electric motors for washing machines, or inverter circuits for induction cooktops.

The performance of an appliance can be negatively influenced by the deviations in the line voltage. For example, if a cooking range is designed for operation with a line voltage of 240V, but is used in an area where the line voltage is 208V, the difference in line voltage will have a negative impact on the cooking performance of the cooking range with respect to pre-set cooking profiles Rather than designing a different control system for each different nominal line voltage, it would be desirable to provide a single cost effective control system for an appliance. Such a control system would allow the appliance to be used with a variety of line voltages. To be attractive for such applications the control system should either automatically adapt to the applied line voltage, or at least be readily and simply pre-settable to various line voltages in the factory or during installation. For example, if a cooking range is able to sense that 208V is being supplied on the power line, it can adjust pre-set cooking profiles/parameters so that they are specifically tailored to the lower voltage (208V) operation, thereby providing uniform cooking results independent of the difference in the line voltages. FIGS. 5, 6 and 7 illustrate how the control may be adapted to different voltages by altering the duty cycle of the relays for different conditions in accordance with the principles of the invention.

In addition, it would be desirable to provide a control system for an appliance which automatically compensates for over-voltage or under-voltage conditions without any apparent difference in the performance of the appliance, thereby preventing damage to the appliance and/or avoiding a potential safety hazard, all without interrupting the use and enjoyment of the appliance.

BRIEF DESCRIPTION OF THE INVENTION

As described herein, the preferred embodiments of the present invention overcome one or more of the above or other disadvantages known in the art.

One aspect of the present invention relates to a control system for determining a magnitude of a voltage and controlling an application of the voltage to at least one load device of an appliance. The control system includes a threshold-crossing circuit configured to receive a representation of the voltage and to provide an output signifying the voltage crossing a predetermined voltage threshold; and a processor which receives the output from the threshold-crossing circuit and determine the magnitude of the voltage based on the output and a line frequency based on the period of the output, determines an initial cooking profile from a group of cooking profiles based on a user selected initial setting for controlling the application of the voltage to the at least one load device, and adjusts the application of the voltage to the at least one load device based on the determined magnitude of the voltage.

Another aspect of the present invention relates to a method for determining a cooking profile applied to a load device. The method includes the steps of receiving an initial setting; selecting an initial cooking profile corresponding to said initial setting and a nominal magnitude of an input voltage; measuring an time interval between threshold crossings of an input voltage; determining a line frequency based on said measured time interval; determining a magnitude of said input voltage based on said time interval of said threshold crossings; and adjusting a cycle of the application of said voltage based on said determined voltage magnitude and said determined line frequency.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein.

DETAILED DESCRIPTION OF THE PREFERRED EMBODIMENTS OF THE INVENTION

In the following description, preferred embodiments of the control system and the method of the present invention are discussed in connection with a cooking range having a cooking oven that uses electricity to generate cooking heat. The cooking range may have electrical or gas cooking elements at its top surface. Needless to say, the control system and the method of the present invention may be used in other types of appliances, including but not limited to, cooktops, microwave ovens, wall ovens, dryers, etc. or a combination of these appliances. Thus, the description herein, in conjunction with the cooking range, is not to be interpreted as limiting the usage of the control system and the method of the present invention to just such an appliance. Rather, the description just illustrates how the control system and the method of the present invention can be used in an appliance.

Figure 1:
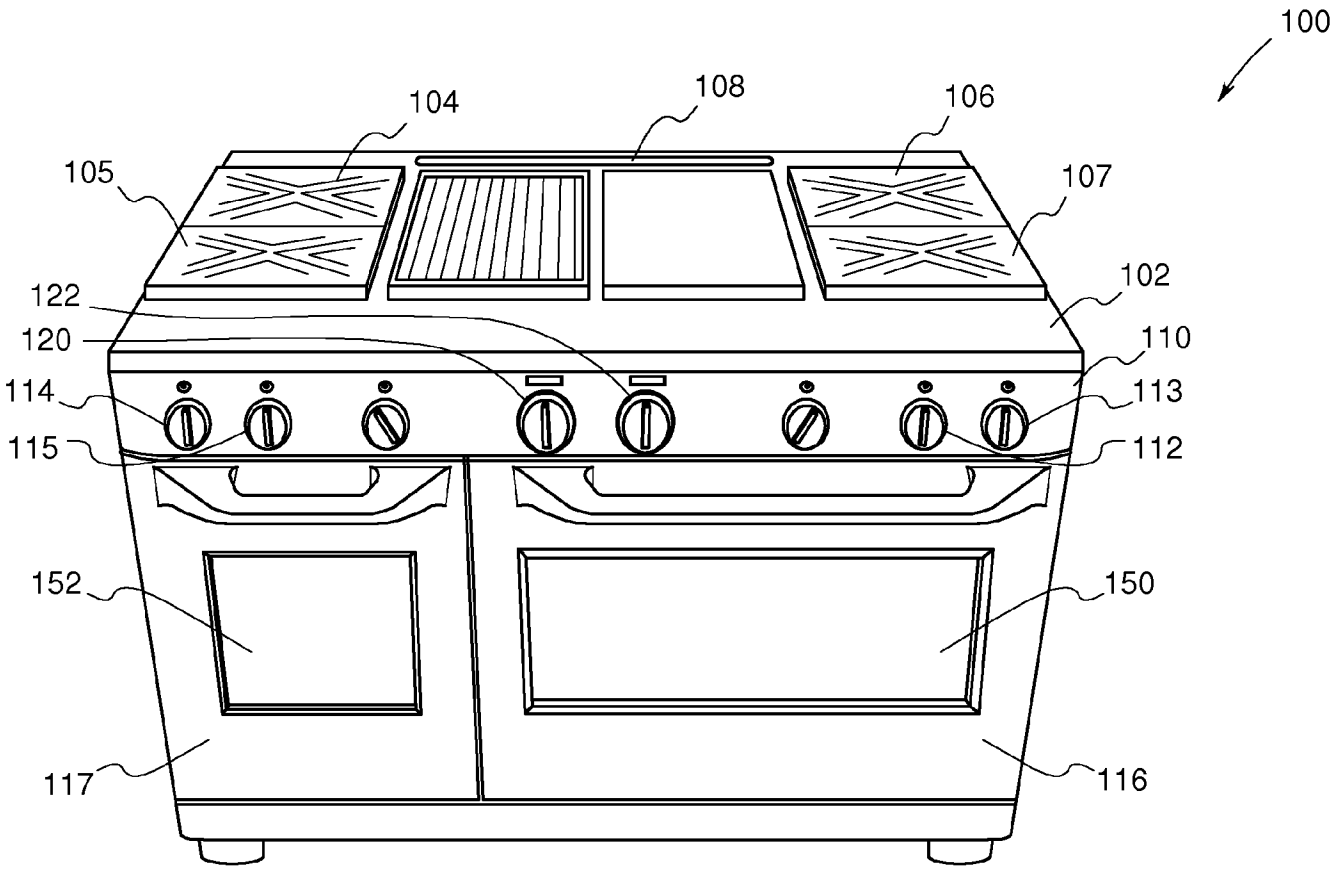
FIG. 1 is a perspective view of an exemplary appliance incorporating a preferred embodiment of the control system device of the present invention.

An exemplary cooking range is designated generally by reference numeral 100 in FIG. 1. The cooking range 100 has a cook top 102 containing surface cooking elements 104, 105, 106 and 107. The surface cooking elements 104, 106 may be gas burners, electrical heating elements, etc. Additionally, the cook top 102 may have a vent 108 positioned generally at the rear of the cook top 102 for drawing heat and exhaust air away from the surface cooking elements 104-107. A control surface 110 is positioned generally at the front of the cooking range 100. A plurality of controls such as knobs 112, 113, 114 and 115 are positioned on the control surface 110 for controlling the operation of the respective surface cooking elements 104-107.

Doors 116, 117 close access to respective oven cavities 150, 152 of the cooking range 100. Each oven cavity 150, 152 is used for cooking and is heated by at least one heating element (not shown in FIG. 1). The heating elements may include, but are not limited to, convection, microwave, baking, broiling elements or a combination of the elements. In addition, the number and types of the heating elements may vary. In the following description and in FIG. 2, reference numerals 230, 240 are used to designate heating elements, such as baking elements disposed in the respective cavities 150, 152. Reference numerals 232, 242 are used to designate heating elements such as convection elements disposed in the respective cavities 150, 152. Reference numerals 234, 244 are used to designate heating elements such as broil elements disposed in respective cavities 150, 152. Heating elements 230, 232, 234, 240, 242 and 244 are electrical resistance elements and when energized at their respective rated power, radiate primarily in the infrared (1-3 micron) region of the electromagnetic spectrum. Such heating elements are known in the art and therefore are not described in detail here. Heating element 230, 232, 234, 240, 242 and 244 each are designed to operate at about 100% of rated power when energized by a specific line voltage, for example at 240V.

Figure 2:
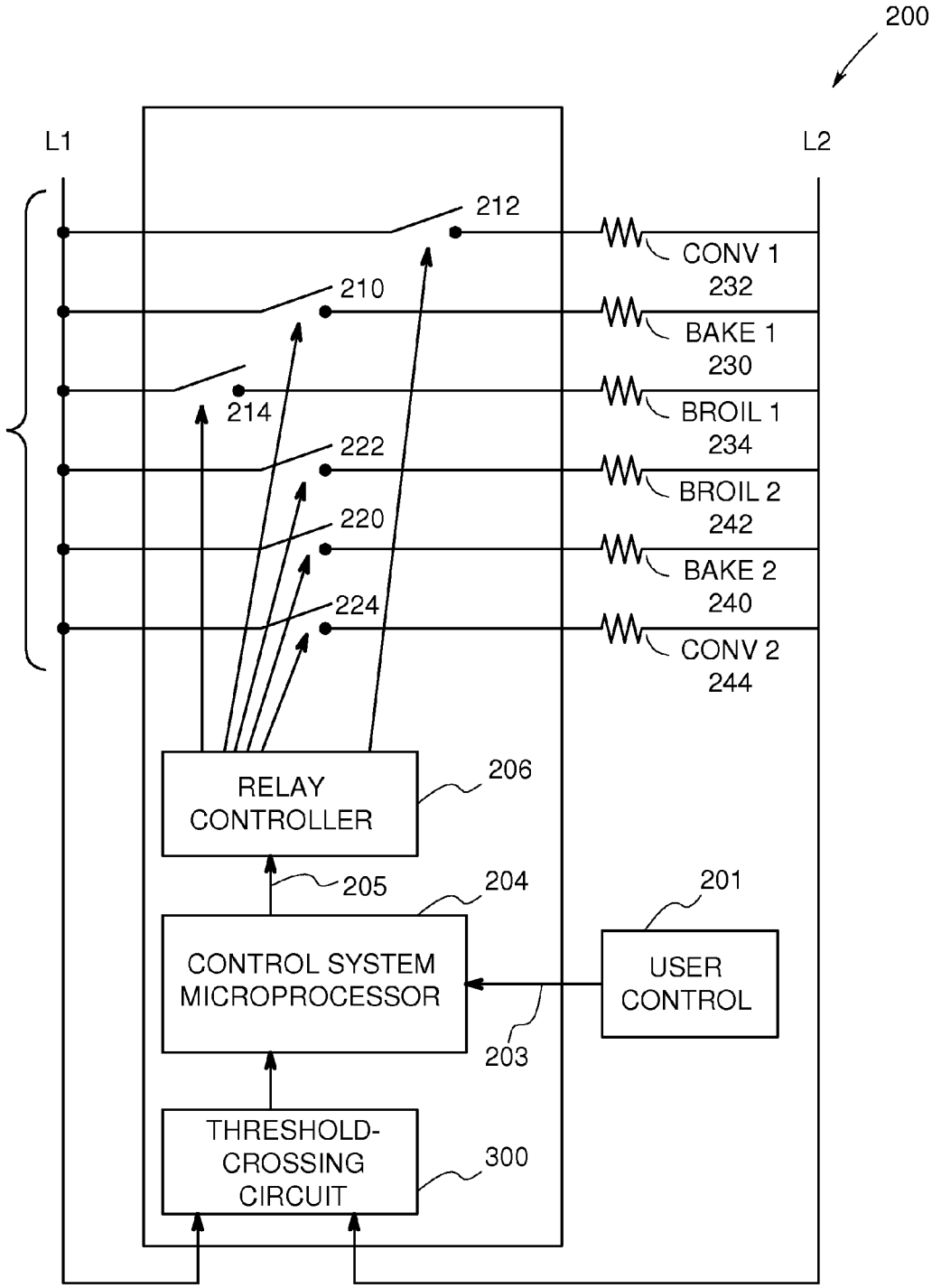
FIG. 2 is a functional block diagram of the control system for the appliance of FIG. 1.

FIG. 2 illustrates, in block diagram form, an embodiment of a control system 200 in accordance with the present invention for the cooking range 100. The cooking range 100 is coupled to a standard AC power source (e.g., 50 Hz or 60 Hz), which could have any voltage but preferably has a voltage between 110V and 240V inclusive, via power lines L1 and L2.

A user activates the control system 200 by a user control 201. The user control 201 may be a knob such as knob 120, 122 on the control surface 110 or may be a human-machine interface such as a touch screen. The user uses the control 201 to send interface settings 203 to the control system microprocessor 204. Typical interface settings 203 include the specific oven cavity to be utilized, the cooking temperature, the type of cooking desired, such as but not limited to baking, convection, broiling or microwaving. Furthermore, a user may select a cooking time as an interface setting 203. Such interface settings 203 may be referred to as an initial setting. The initial settings are associated with corresponding initial cooking profiles. The control system microprocessor 204 utilizes the interface settings 203 (i.e., the initial setting) and the output 320 of a threshold-crossing circuit 300 to determine an applied cooking profile 205. The cooking profile 205 is implemented by the microprocessor 204 and relay controller 206 to switch relays 210, 212, 214, 220, 222 and 224 in order to control the operation of the heating elements 230, 232, 234, 240, 242 and 244, respectively. All of the heating elements 230, 232, 234, 240, 242 and 244 and relays 210, 212, 214, 220, 222 and 224 are connected in parallel arrangement with each other such that they may be utilized individually.

In the illustrative embodiments herein described, the control system microprocessor 204 controls the heat/load output of the heating elements 230, 232, 234, 240, 242 and 244 by controlling the switching rate of the relays to establish the desired duty cycle of the voltage applied to the heating elements 230, 232, 234, 240, 242 and 244.

Figure 3A:
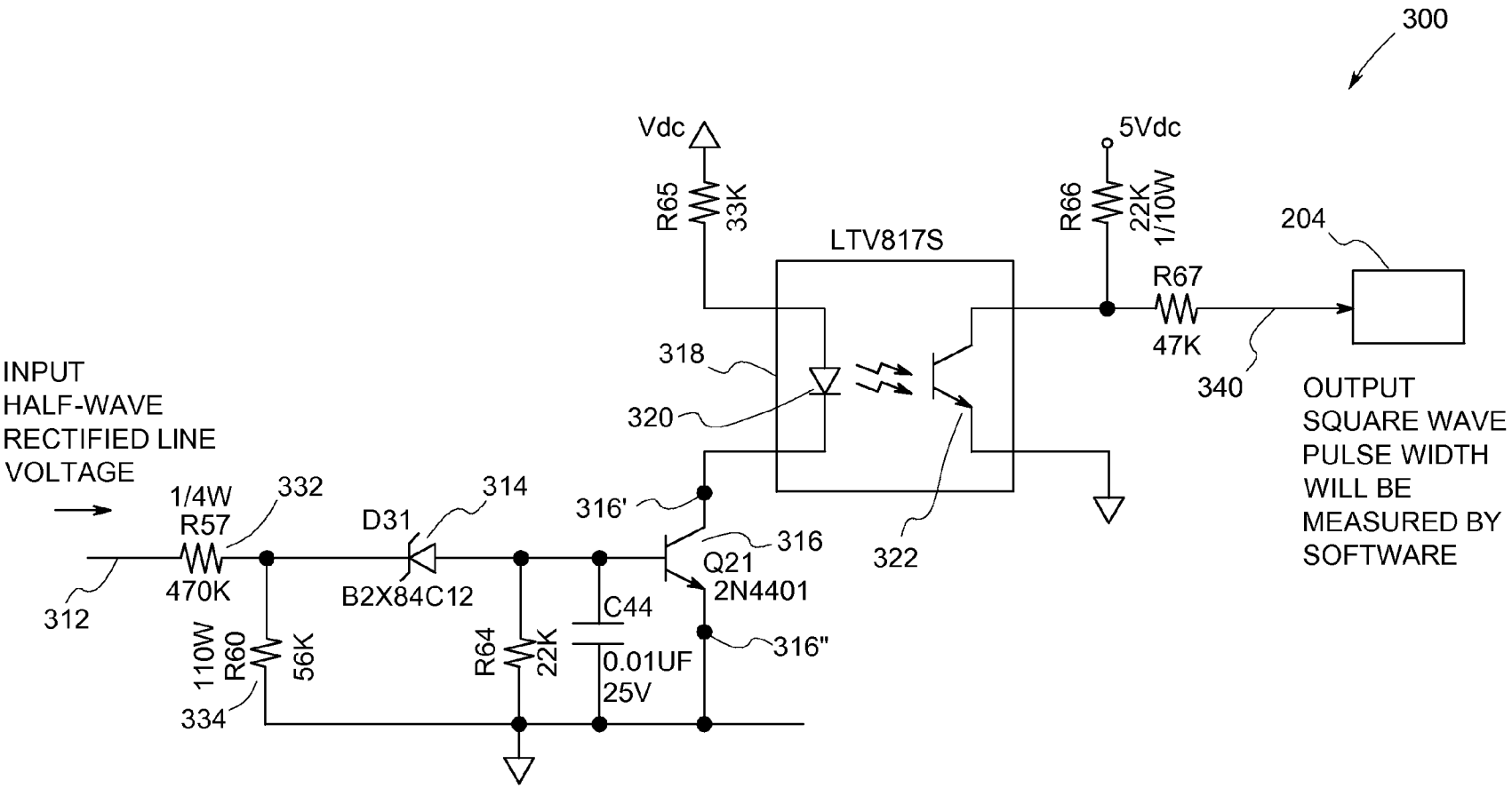
FIGS. 3A-3D illustrate an exemplary schematic diagram of a threshold-crossing circuit for the control system of the present invention and the voltage/current therefrom.
Figure 3B:
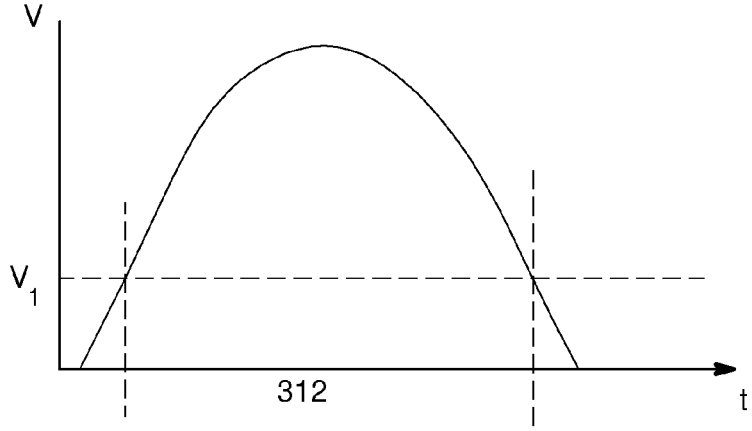

The threshold-crossing circuit 300 shown in FIG. 3A is by way of an example and will be described generally here. The threshold crossing circuit 300 receives as an input 312 a half-wave rectified sinusoidal line voltage (see FIG. 3B). Half-wave rectification is known in the art and therefore will not be discussed in detail herein.

The input 312 is provided to circuit 300, which is comprised principally of zener diode 314, transistor 316, and electro-optical coupler 318, which comprises LED 320, and photodetector 322. The optical coupler 318 outputs a square wave 340 with pulse width and frequency corresponding to the applied AC voltage and frequency respectively.

Figure 3C:
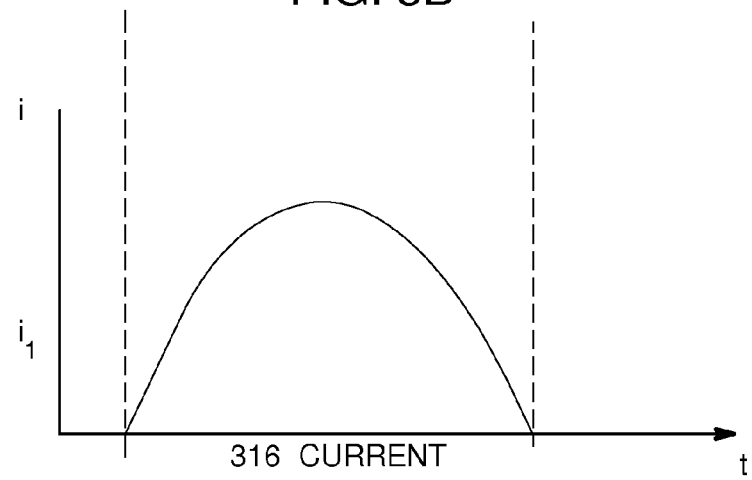
Figure 3D:
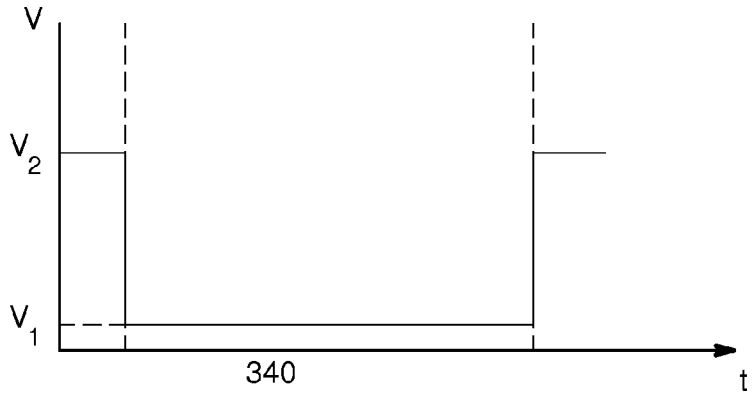

More specifically, zener diode 314 serves to block current injection into the base of transistor 316 until a minimum pre-determined threshold voltage is developed across zener diode 316 from input half-wave-rectified sinusoidal voltage 312. This enables the microprocessor to determine the magnitude of the applied voltage. In the illustrative embodiments of the threshold detection circuit described herein, the threshold voltage is twelve volts (12V). However, it is to be understood that this value is intended to be illustrative and not limiting and other voltage values may be selected and similarly utilized. Zener diode 314 in conjunction with a voltage divider comprised of resistors R57 (332) and R60 (334) limits the voltage applied to the base of transistor 316. Once at least 12V is developed across zener diode 314, and as long as the level of half-wave-rectified sinusoid is above 12V, current will begin to flow into transistor 316. This causes transistor 316 to begin to conduct current from the collector 316' to the emitter 316" (see FIG. 3C). When current flows through transistor 316, it also flows through LED 320 causing LED 320 to emit light. The light generated from LED 320 is detected by photodetector 322, and current begins to flow through the photodetector 322. The current through photodetector 322 causes the start of a low-going edge of square wave 340. Current will cease to flow in zener diode 314, transistor 316, LED 320, and photodetector 322 once the voltage developed across zener diode 314 falls below 12V, causing the high-going edge of square wave 340 (see FIG. 3D). Since the rate of rise of the half-wave-rectified sinusoid at 312 is related to the magnitude of the AC line voltage, the width of the pulse of square wave 340 will vary as the magnitude of the AC line voltage varies. In the illustrated embodiment, transistor 316 is represented by an NPN bipolar transistor. In one aspect, the NPN transistor may be selected to be the well-known, commonly available, 2N4401. However, it would be recognized by those skilled in the art that the NPN transistor may also be represented by any suitable bipolar transistor sufficient for the application, selection of which is known to those skilled in the art. Other embodiments are possible including the use of other semiconductor technologies such as MOSFET. In one non-limiting aspect, the optocoupler 322 may be the well-known and commonly available LTV8178. However, the optocoupler may also be represented by any suitable optocoupler or other LED and photodetector, selection of which is known to those skilled in the art. Other embodiments are possible, including non-isolated circuits not employing optocouplers or other isolating technologies such as transformers.

The output signal 340 (FIG. 3D) generated by the photodetector 322 is provided to the control system microprocessor 204 (shown in FIG. 2). The control system microprocessor 204 measures the time that the generated signal 320 is in one desired state. For example, the control system microprocessor 204 may measure the time interval that the generated signal 340 is in a low state (0V). In another aspect, the control system microprocessor 204 may measure the time interval that the generated signal 340 is in a high state.

The time interval that square wave 340 is in a low state, low pulse width, (or a high state, high pulse width) for a 240V signal will differ from the time interval that the square wave 340 is in a low state (or a high state) for a 208V signal. The measured time interval may be used to initially determine if the voltage is in the 120 volt range, the 208 volt range or the 240 volt range. Having determined the range the appropriate equation can then be selected to more precisely determine the magnitude the voltage using a predetermined linear transfer function. For example with reference to Table 1, if the measured pulse width, PW is less than 0.0043 seconds, the magnitude of the line voltage is less than 135 volts, which corresponds to the 120 volt category; if greater than 0.0043 and less than 0.0055 seconds, the magnitude of the line voltage is between 135 and 185, which is in the category identified as "low voltage"; if the pulse width (PW) is greater than 0.0055 and less than 0.0060, the magnitude of the voltage is between 185 and 223, which is in the 208 volt category and if the PW is greater than 0.0066, the voltage is greater than 224 and is in the 240 volt category. Having determined the voltage category for the line voltage, the microprocessor can then select the appropriate equation for a more precise determination of the voltage to appropriately compensate for variation from the nominal for the particular voltage category.

For example, the calculations used to determine the approximate magnitude of the line voltage applied to input 312 at 60 Hz are shown in Table 1

TABLE 1

| 60 Hz | | | | |
|---|---|---|---|---|
| Range (v) | PW range (s) | PW (s) * 10000 range | Eq --> V = m * PW * 10000 + b | Bucket |
| <=135 | <=0.0043 | <=43 | V = 1.7310 * PW * 10000 + 60.1956 | 120 |
| 135 < V < 185 | 0.0043 < PW < 0.0055 | 43.01 < PW < 54.99 | V = 4.2409 * PW * 10000 − 49.2027 | Low voltage |
| 185 <= V <= 223 | 0.0055 <= PW <= 0.0060 | 55 <= PW <= 60 | V = 7.5700 * PW * 10000 − 231.196 | 208 |
| 224 < V | 0.0060 < PW | 60.01 < PW | V = 10.3519 * PW * 10000 − 397.6398 | 240 |

In the illustrative embodiment, the AC wave applied to input 312 may be a 60 Hz AC power signal. However, power signals of different frequencies, such as 50 Hz, could be similarly used. This has an impact on the pulse width of the output and is accounted for by first determining the frequency of the line. The determination of the line frequency using a zero-crossing (or threshold crossing) detector is well known in the art. In the method described herein, the circuitry and a timer within a microcontroller measure the timing between rising edges of the input voltage signal, thereby measuring the period of the signal. The measured period is then compared with the expected period of 50 Hz or 60 Hz line frequencies and the frequency is thus determined. Once the line frequency is known the corresponding look-up table is used for subsequent calculation of the line voltage. In another aspect of the invention, the time between falling edges may be used to measure the period (and subsequently the frequency.)

The signal 340 presented to the microprocessor can also be used to determine the line frequency that is then used to select the appropriate table by which the line voltage is determined. The time interval between rising edges (low-to-high transitions) of signal 340 can be measured to determine the line frequency. This time interval is the period of the applied AC voltage and is inversely proportional to the line frequency. A timer of sufficient resolution located within the microprocessor is used to measure the period. The oscillator that serves as the time base for the timer must be of sufficiently high accuracy such that the microprocessor can distinguish the difference between the frequencies of interest. If the accuracy is too low, frequencies of interest that are too closely spaced cannot be determined with a sufficient degree of accuracy. Once the period of the applied AC voltage has been measured, it is compared to a range of expected values. The range of expected values encompasses the frequencies of interest and the accuracy of the time base or oscillator. For example, the period (T-line) of a 50 Hz frequency is 20 milliseconds. If an oscillator of 2% tolerance is used, the microprocessor may measure the period (T-measured) between 19.6 (T-low) and 20.4 (T-high) milliseconds for a 50 Hz line frequency. If T-measured falls between T-low and T-high (T-low<T-measured<T-high), the AC line frequency is determined to be T-line, or 50 Hz in this example. There exists similar expected values for 60 Hz, namely 16.3 and 17.0 milliseconds respectively. As can be seen from this example, there is no overlap between the range of expected values for 50 and 60 Hz line frequencies so an oscillator tolerance of 2% is acceptable although other oscillator tolerances will also be acceptable. Although the frequencies of interested mentioned here are 50 and 60 Hz, the determination of other frequencies is also possible. It is also possible to measure the interval between falling edges (high-to-low transitions) of signal 340 to determine the period of applied AC voltage. Other frequency measurement techniques known to those skilled in the art are also possible, such as frequency discriminators, band-pass filters, and Fourier analysis.

The pulse measurement based calculations used to approximate the line voltage at 50 Hz applied at the input 312 may be determined as shown in Table 2:

TABLE 2

| 50 Hz | | | | |
|---|---|---|---|---|
| Range (v) | PW range (s) | PW (s) * 10000 range | Eq --> V = m * PW * 10000 + b | Bucket |
| <=135 | <=0.0051 | <=51 | V = 1.4401 * PW * 10000 + 60.1987 | 120 |
| 135 < V < 185 | 0.0051 < PW < 0.0065 | 51.01 < PW < 64.99 | V = 3.5273 * PW * 10000 − 48.9065 | Low voltage |
| 185 <= V <= 223 | 0.0065 <= PW <= 0.0072 | 65 <= PW <= 72 | V = 6.1843 * PW * 10000 − 222.9746 | 208 |
| 224 < V | 0.0072 < PW | 72.01 < PW | V = 8.6806 * PW * 10000 − 402.0573 | 240 |

Figure 4:
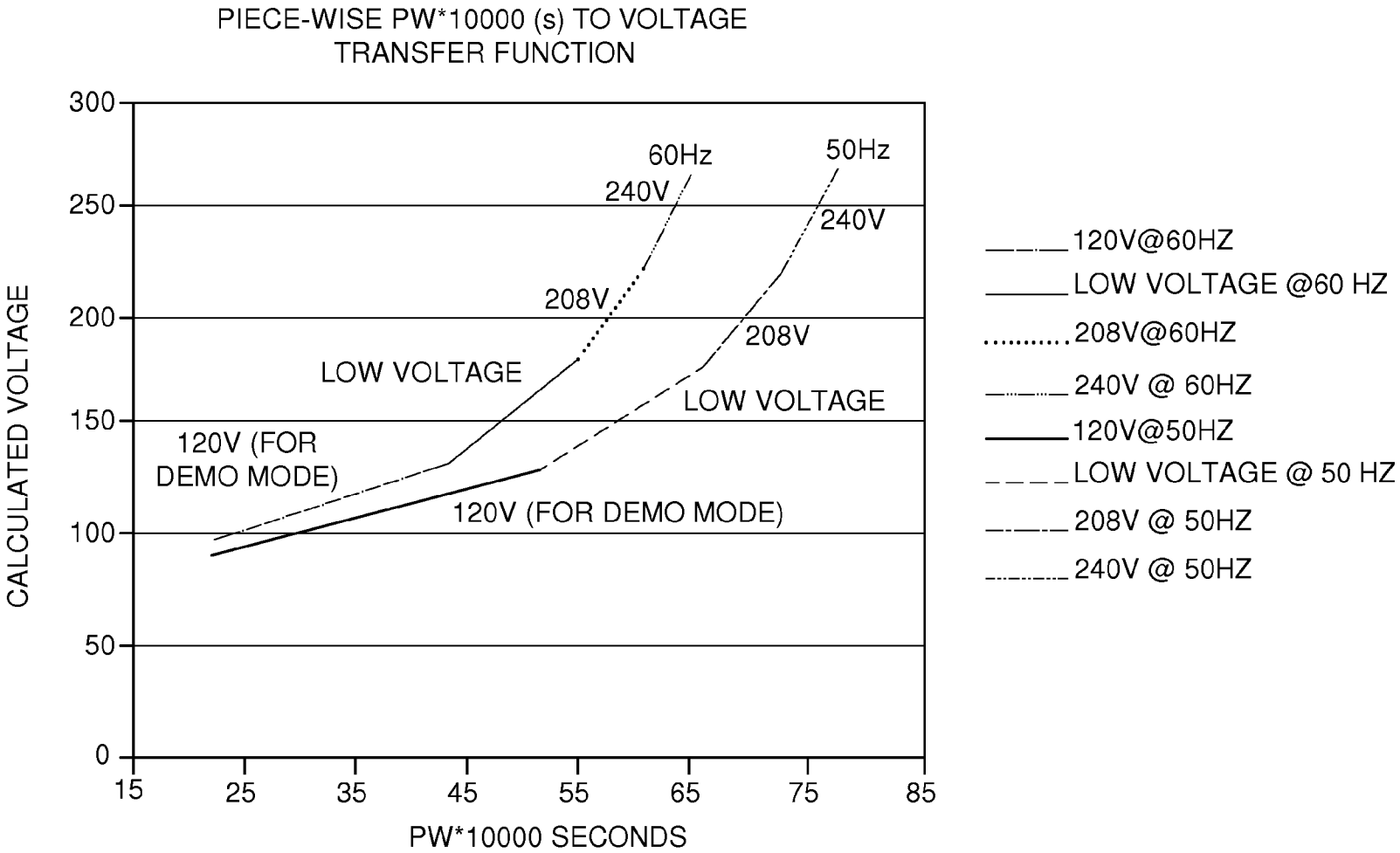
FIG. 4 is a graphic representation of an exemplary means for determining a line voltage based on a measured pulse width.

FIG. 4 illustrates a piece-wise linear representation of the equations shown in Tables 1 and 2. As would be known by those skilled in the art, the piece-wise linear representation of voltage ranges shown in FIG. 4 may be implemented using a look-up table. Furthermore, although Tables 1 and 2 represent a specific set of equations for determining an input line voltage, it would be recognized by those skilled in the art that the values contained in Tables 1 and 2 may be altered or modified without altering the principles of the invention. Hence, such alterations or modifications to the piece-wise linear representation shown in FIG. 4 have been contemplated and considered to be within the scope of the invention. Although Tables 1 and 2 illustrate discrete voltage ranges meant essentially for a particular configuration, it would be further recognized that Tables 1 and 2 are not limited to the values shown and may be supplemented or their contents altered with any number of discrete voltage ranges and profiles as well as for continuous measurement with a single continuously varying profile. Such alternations would be well known to those skilled in the art and would not require undue experimentation to achieve desired results.

An example of such compensation will now be described in which the user has selected a cooking temperature of 350 degrees for 30 minutes (initial setting), and the voltage category has been determined to be the 240 volt category based on the measured PW in accordance with Table 1. The processor 204, determines the actual input voltage using the equation from Table 1, and provides appropriate changes to the cooking parameters (i.e., altered or adjusted cooking profile), based on the actual applied voltage magnitude to achieve the results associated with the desired initial settings (e.g., temperature and duration).

Figure 5:
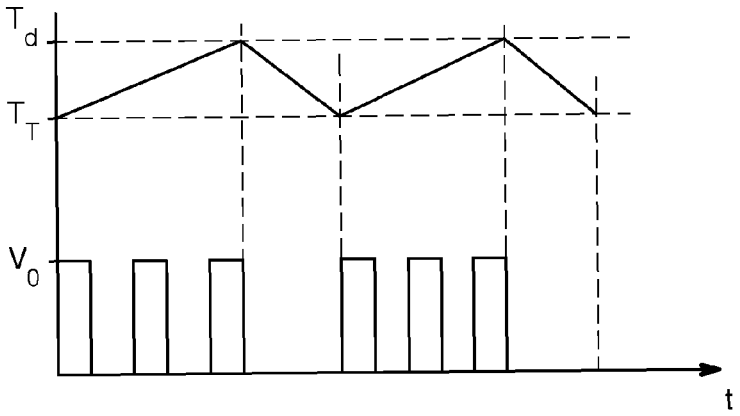
FIG. 5 is a graphic representation of an exemplary voltage and temperature cooking profile.

FIG. 5 illustrates an exemplary simplified voltage and heat charts of an initial cooking profile. In this illustrated example, a nominal input voltage ($V_o$) is applied to heating elements for a known time period with a known duty cycle to achieve a desired temperature ($T_d$). During the period the voltage is applied to the heating elements (i.e., heating period) the temperature raises from a nominal room temperature to a desired temperature. This is achieved by cycling a corresponding one of the relays shown in FIG. 2 at a known rate. After the desired temperature is achieved, the voltage is turned off by switching "off" the corresponding relay. Otherwise, the temperature would continue to increase beyond the desired temperature. The desired temperature may be determined based on an actual measured value or by estimating a temperature based on the time duration the voltage is applied to the heating elements and the heating characteristics of the appliance. In this illustrated example, the duty cycle during the heating period is set at fifty percent (50%).

However, with the voltage removed from the heating coils (cooling period), the temperature in the appliance begins to decrease. It would be appreciated that the heating characteristics of the appliance would maintain the temperature for a known period of time before decreasing too far. However, for the purposes of this illustration, the temperature is shown to decrease immediately after the voltage is removed from the heating coils. Generally, the decrease in the temperature is based on the characteristics of the components and materials of the oven unit.

When the temperature decreases to a threshold temperature, the voltage is again applied to the heating elements to raise the temperature back to the desired temperature. The voltage ($V_o$) is applied for a known time with a known duty cycle to again achieve the desired temperature. The duty cycle may be altered or adjusted to provide a desired average amount of energy during the heating period. For a given voltage, the higher the duty cycle, the more energy is applied. Generally, the duty cycle increases as voltage decreases in order to maintain substantially the same amount of energy input to the oven cavity. This process of application of voltage in a pulsed (duty cycle) manner to raise the temperature repeats for the duration of time that is specified or input by a user.

In this simplified illustration, the user specified values (i.e., temperature and time) are translated into a cooking profile represented as a rate or duty cycle of the application of the input voltage, considering the known heating characteristics of the appliance, to achieve the user specified input values. One or more duty cycles may be preloaded in the control system processor. In one aspect of the invention, the duty cycles may be predetermined and preloaded for predetermined temperatures. In another aspect, duty cycles may be determined for temperatures for which duty cycles are not preloaded by interpolating between two predetermined duty cycles of adjacent temperatures.

Figure 6:
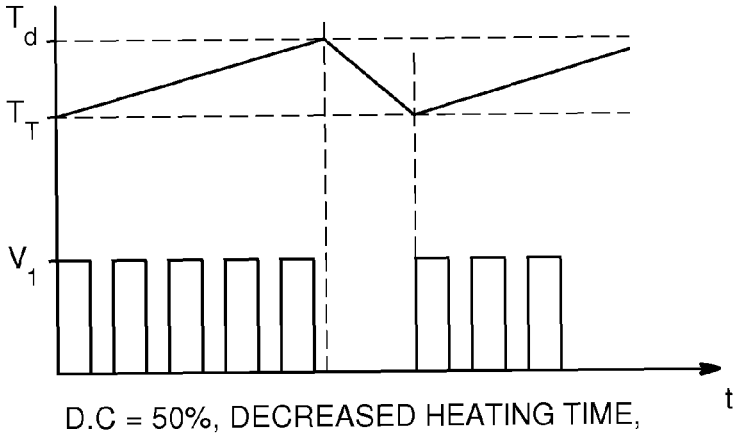
FIG. 6 is a graphic representation of an exemplary under voltage and temperature cooking profile.

FIG. 6 illustrates exemplary voltage and heating charts wherein the input voltage ($V_1$) is less than the expected nominal value ($V_0$). In this case, when the voltage is applied for the time specified in the initial cooking profile, the temperature may take a longer time to reach the desired temperature setting if there is no modification of the duty cycle. Alternatively, the oven cavity may fail to achieve the desired temperature. In either case, such operation results in under performance of the cooking unit.

Figure 7:
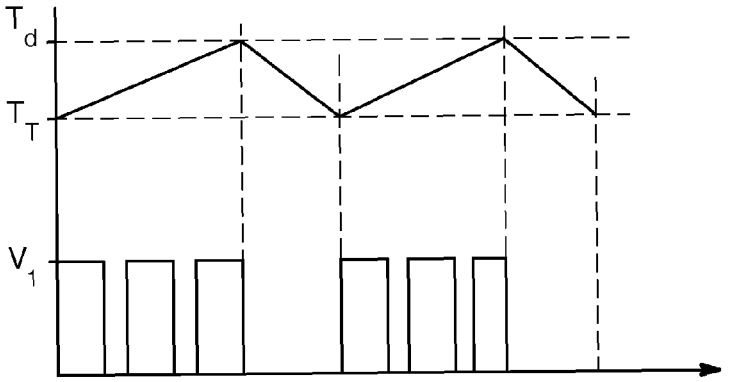
FIG. 7 is a graphic representation of an exemplary voltage and temperature cooking profile adjusted for voltage conditions.

FIG. 7 illustrates exemplary voltage and heating charts wherein the duty cycle of the initial cooking profile is adjusted based on the determined input voltage to compensate for a departure from the nominal value or reference value of the input voltage in accordance with an embodiment of the invention. As illustrated, the actual measured line input voltage ($V_1$), which is lower that the nominal voltage $V_o$, is applied to the heating elements for a longer period of time, by increasing the duty cycle from 50% to seventy-five percent (75%) (i.e., ¾ on, ¼ off), so as to achieve the desired temperature ($T_d$) in approximately the same amount of time as would have been achieved at the 50% duty cycle operating at the nominal input voltage value. Thus, the duty cycle of the applied voltage is altered (in this instance, increased) to compensate for the decrease in the line voltage to allow energy to be applied to the oven cavity at approximately the same rate as would have been applied under nominal conditions.

Returning to FIG. 2, power control system 204 operates each heating elements 230, 232, 234, 240, 242 and 244 at one of a plurality of power levels. These levels are available to adjust the power, by varying the duty cycle, applied to the heating elements 230, 232, 234, 240, 242 and 244 such as, for example, to overdrive the heating elements 230, 232, 234, 240, 242 and 244 when operating in a transient heat up mode to rapidly heat the elements 230, 232, 234, 240, 242 and 244 to radiant temperature. The power control system 204 may control a pulse repetition or pulse width to provide an expected heat output at a specific voltage input. In addition, power control system 204 may operate one or more elements to achieve a desired temperature for one of the elements. For example, at 240 VAC, power control module 204 may operate Bake 1 and Bake 2, assuming these elements are in the same oven cavity, concurrently during the heating period to achieve a desired temperature. However, at 208 VAC, Bake 1 may be cycled on and off, while Bake 2 is maintained in a continuously "on" condition during the heating cycle in order to achieve the desired temperature Although the invention has been described with regard to the operation of relays for controlling the application of adjusted cooking profiles to the heating elements, it would be recognized that similar adjustment may be made when triac devices are employed. In the case of triac devices controlling the heating elements, a phase angle firing is adjusted to compensate for changes in a determined line voltage. The adjustment of the duty cycle, in the case of relays, or firing angle, in the case of triacs, is chosen to achieve a desired time rate of change of temperature so that the effect of the desired initial cooking profile is achieved.

The above-described methods according to the an embodiment of the invention shown herein can be realized in hardware, i.e., an FPGA, ASIC, or as software or computer code that can be stored in a recording medium such as a CD ROM, an RAM, a floppy disk, a hard disk, or a magneto-optical disk or downloaded over a network, so that the methods described herein can be rendered in such software using a general purpose computer, or a special processor or in programmable or dedicated hardware, such as an ASIC or FPGA. As would be understood in the art, the computer, the processor or the programmable hardware include memory components, e.g., RAM, ROM, Flash, etc. that may store or receive software or computer code that when accessed and executed by the computer, processor or hardware implement the processing methods described herein.

Thus, while there have shown, described and pointed out fundamental novel features of the invention as applied to preferred embodiments thereof, it will be understood that various omissions, substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A control system for determining a magnitude of a voltage and controlling an application of the voltage to at least one load device of an appliance, said control system comprising:

a threshold-crossing circuit configured to receive a representation of the voltage and to provide an output signifying said voltage crossing a predetermined voltage threshold; and a processor configured to:

receive the output from the threshold-crossing circuit and determine the magnitude of the voltage based on said output and a line frequency based on the period of said output;

determine an initial cooking profile from a group of cooking profiles based on a user selected initial setting for controlling the application of the voltage to the at least one load device; and adjust said application of the voltage to the at least one load device based on the determined magnitude of the voltage.

2. The control system of claim 1, wherein the output of the threshold-crossing circuit is a square wave having a pulse width related to the magnitude of the voltage source.

3. The control system of claim 2, wherein the processor relates the provided square wave pulse width to a set of predetermined voltage ranges.

4. The control system of claim 3, wherein the processor activates at least one relay associated with the at least one load device.

5. The control system of claim 1, wherein the at least one load device is selected from group consisting of: a broil element, a bake element, a convection element and a microwave element.

6. The control system of claim 1, further comprising a user interface for providing said initial setting.

7. The control system of claim 1, wherein said initial setting profile defines a duty cycle, and wherein said duty cycle is adjusted by changing at least one element selected from the group consisting of: a pulse duration, a phase angle firing, cycle skipping and duty cycle.

8. The device of claim 3, wherein the processor activates at least one triac associated with the at least one load device.

9. A method for determining a cooking profile applied to a load device, said method comprising the steps of:

receiving an initial setting;

selecting an initial cooking profile corresponding to said initial setting and a nominal magnitude of an input voltage;

measuring a time interval between threshold crossings of an input voltage;

determining a line frequency based on said measured time interval;

determining a magnitude of said input voltage based on said time interval of said threshold crossings; and adjusting a cycle of the application of said voltage based on said determined voltage magnitude and said determined line frequency.

10. The method of claim 9, wherein said initial cooking profile defines a corresponding nominal duty cycle for the voltage applied to the load device.

11. The method of claim 9, further comprising outputting a control signal in accordance with the initial cooking profile.

12. The method of claim 11, wherein said initial cooking profile is adjusted by changing the duty cycle of the voltage applied to the load device.

13. The method of claim 12, wherein said control signal is applied to at least one element selected from a relay and a triac.

14. The control system of claim 2, wherein the processor relates the provided square wave period to said line frequency.

* * * * *